US006381789B1

(12) United States Patent
Bernardino et al.

(10) Patent No.: US 6,381,789 B1
(45) Date of Patent: May 7, 2002

(54) LAUNDERING PROCESS AND MACHINE

(75) Inventors: Flávio Erasmo Bernardino, São Paulo (BR); Robert Joseph Pinkowski, St. Joseph, MI (US); Denilson Fernandes De Oliveira; Vera Coelho Aguiar, both of São Paulo (BR)

(73) Assignee: Multibras S/A Electrodomesticos, Sao Paulo (BR)

( * ) Notice: Subject to any disclaimer, the term of this patent is extended or adjusted under 35 U.S.C. 154(b) by 0 days.

(21) Appl. No.: 09/364,482

(22) Filed: Jul. 30, 1999

(51) Int. Cl.[7] ..... D06F 33/00
(52) U.S. Cl. ..... 8/158; 8/159; 68/12.12
(58) Field of Search ..... 8/158, 159; 68/12.12

(56) References Cited

U.S. PATENT DOCUMENTS

| | | | | |
|---|---|---|---|---|
| 2,709,908 A | * | 6/1955 | Altorfer, Jr. et al. | 68/12.12 X |
| 3,214,665 A | * | 10/1965 | Billings et al. | 68/12.12 X |
| 4,916,768 A | * | 4/1990 | Broadbent | 8/159 |

FOREIGN PATENT DOCUMENTS

| | | | | |
|---|---|---|---|---|
| JP | 102694 | * | 4/1990 | 68/12.12 |
| JP | 309994 | * | 12/1990 | 68/12.12 |
| JP | 9793 | * | 1/1991 | 68/12.12 |

* cited by examiner

*Primary Examiner*—Philip Coe
(74) *Attorney, Agent, or Firm*—Darby & Darby

(57) ABSTRACT

A laundering process for a laundering machine, the machine comprising a tank (1), for containing a washing liquid, and a perforated basket (2), for containing the clothes and which is internal to the tank (1), the laundering process comprising a soaking step, a washing step and generally a centrifugal step, a control unit commanding the operation of the laundering machine. The soaking step comprises the following phases: feeding the tank (1) with the washing liquid, until reaching a determined soaking level (L2), which is lower than a respective washing level (L1) selected among a plurality of washing levels, and submitting the load of clothes immersed in the washing liquid, alternately, to a resting condition during a resting period (Tr), and to an agitation condition, during at least one agitation period (Ta1, Ta2), which is shorter than the resting period (Tr), until the soaking step has been completed.

10 Claims, 1 Drawing Sheet

LAUNDERING PROCESS AND MACHINE

FIELD OF THE INVENTION

The present invention refers to a laundering process to be carried out in a domestic laundering machine, as well as to a domestic laundering machine of the type having a perforated basket mounted inside a tank.

BACKGROUND OF THE INVENTION

In some of the known constructions of laundering machines, the washing operation occurs by agitating the washing liquid (water and detergent) contained inside a perforated basket of said machine, in which is immersed a load of clothes.

The machine starts the laundering process by feeding the washing liquid to the inside of the tank wherein is mounted the perforated basket, until a determined liquid level is reached, corresponding to a certain liquid volume, which is previously defined for washing the load of clothes placed therein. The amount of washing liquid varies with the load of clothes to be washed and, in some appliances, it may be selected according to said load of clothes.

After being filled, the laundering machine starts its washing operation, with a static soaking step, in which the clothes remain, for a determined time interval, in an inert condition and immersed in the washing liquid, before the washing operation is started, with the agitation of the load of clothes and washing liquid (washing load).

In one of the known laundering machine constructions which comprises the tank and the perforated basket with a vertical shaft, the washing is carried out, after the soaking step, by agitating the washing load inside the perforated basket, said agitation being provided by a central agitator, which is for example provided with radial vanes and which reciprocates during the washing process. The agitator acts simultaneously over the washing liquid and mechanically and directly over the clothes immersed in said liquid. The alternate angular movement is transmitted to the agitator from an electric motor, which is operatively coupled to said agitator through a driving shaft.

In this type of washing operation, each reversal of the rotation direction of the agitator occurs after the latter is caused to make an angular displacement which is smaller than a full turn around its rotation shaft.

The movement of the agitator in each rotation direction during the washing operation is determined so as to guarantee a relative movement between the washing liquid and the clothes immersed therein inside the perforated basket. This relative movement is what allows the clothes to be cleaned, since it forces the washing liquid to pass through said clothes.

The washing efficiency is directly related to the agitation pattern, to its agitation rate (number of back and forth movements by time unit), to the rotation angle of the agitator and to the agitator speed (which is determined by the type of motor and reducing rates). The agitation pattern should be set in order to reach a balance regarding the motor effort, dirt removal and wear of the clothes being washed.

After the washing step, the clothes are subjected to a centrifugal step, in order to extract the excess of water and obtain a pre-drying condition.

During the period in which the load of clothes remains in the soaking step, the detergent contained in the water-detergent mixture precipitates onto said load, where it remains until the agitation of the washing step is started.

During this period, the detergent which precipitates on the clothes starts reacting therewith, initiating the cleaning process. However, due to the stationary condition in which are found the clothes immersed in the washing liquid during the soaking step, only a certain amount of the detergent will react with the dirt to be removed from the clothes, said reacted detergent and the dirt remaining trapped in the clothes, preventing the non-reacted detergent, which is present in the washing liquid, from reacting with the clothes and improving the cleaning effect.

Besides impairing the cleaning efficiency, the known laundering processes further have the disadvantage of permitting, during the soaking step, the occurrence of stains in the soaked clothes to be cleaned. Since the load of clothes may not be fully immersed in the washing liquid, part of said non-immersed clothes which is in contact with the environmental air inside the laundering machine cabinet will not be subjected, during the soaking step, to the reactions with the detergent of the washing liquid. The difference between the washing liquid and the environmental air mediums may cause stains in the pieces of the soaked clothes which are only partially submerged.

DISCLOSURE OF THE INVENTION

Thus, it is an object of the present invention to provide a laundering process for a laundering machine having a perforated basket for containing clothes, which optimizes the cleaning of the pieces of a washing load during the soaking step of the laundering process, which allows for a better use of the reactant of the washing liquid and which minimizes the occurrence of stains in said washing load caused by the difference of exposure of said load to the washing liquid medium and to the environmental air medium inside the cabinet of the laundering machine. Another object of the present invention is to provide a laundering machine, which operates according to the above laundering process and which affords obtaining an optimized cleaning of the load of clothes placed in said machine.

These and other objectives are attained through a laundering process for a laundering machine, which comprises a tank for containing a washing liquid and a perforated basket for containing the clothes and which is internal to said tank, said laundering process comprising a washing step, in which the washing liquid has at least one predetermined washing level and, in general, one centrifugal step, said laundering process including a soaking step, which precedes the washing step and which comprises the following phases: a)—automatically feeding the tank with the washing liquid, until reaching a determined soaking level, which is lower than a respective washing level; and b)—submitting the load of clothes immersed in the washing liquid, alternately, to a resting condition, during a resting period, and to an agitation condition, during at least one agitation period, which is shorter than the resting period, the washing step comprising an initial phase of feeding the tank with washing liquid, until the washing level has been completed.

BRIEF DESCRIPTION OF THE DRAWINGS

The invention will be described below, with reference to the attached drawings, in which.

BEST MODE OF CARRYING OUT THE INVENTION

Figure 1:
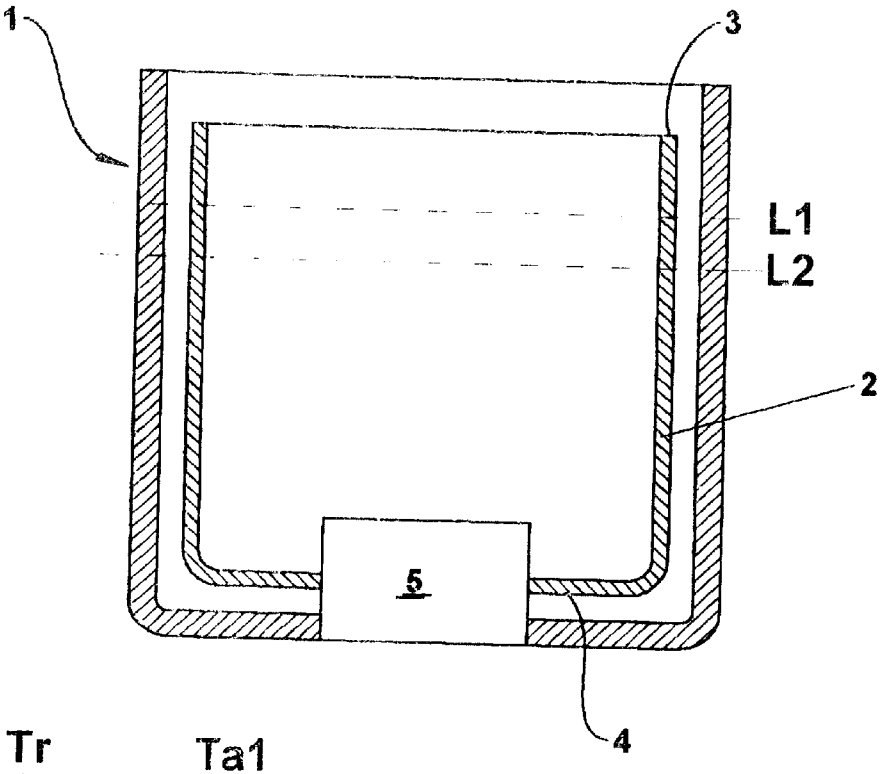
FIG. 1 illustrates schematically, a longitudinal sectional view of a laundering machine basket, which is mounted inside the tank of said machine, showing a washing level and a corresponding soaking level, according to the present invention.
Figure 2:
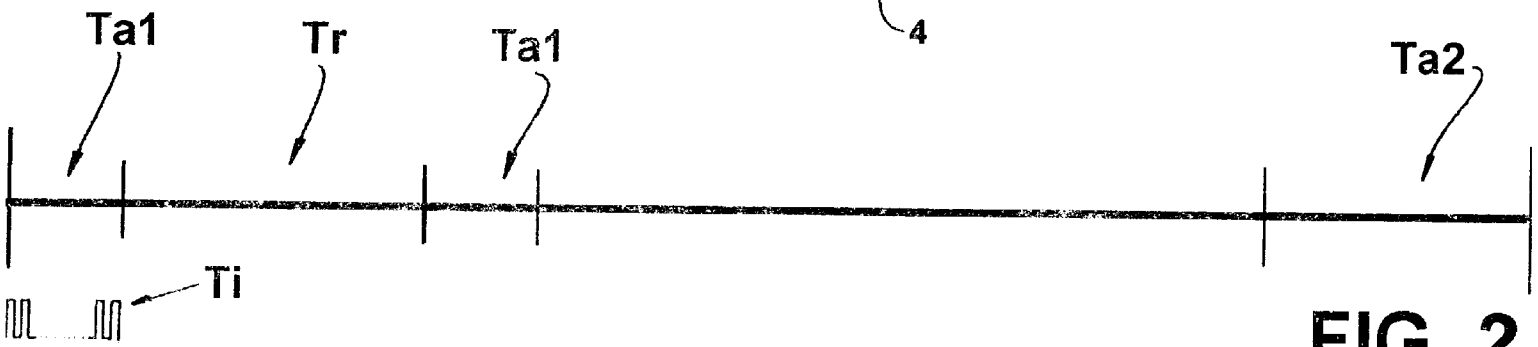
FIG. 2 illustrates, schematically and graphically, the distribution of the agitation, resting and impelling periods in the soaking step.

The present invention will be described in relation to a laundering machine comprising a tubular cylindrical tank 1, which has a vertical shaft and which is provided inside a non-illustrated cabinet. Said tank permits selecting, according to the load of clothes to be cleaned, a determined volume of washing liquid, which will be later drained to the exterior of said laundering machine during one of the steps of the laundering process thereof.

According to the illustrations, inside the tank 1 is concentrically mounted a perforated basket 2, which has a tubular cylindrical form and which is in constant fluid communication with the tank 1 of the laundering machine, said perforated basket 2 having an upper end edge 3, which is open to receive the load of clothes, and a bottom wall 4, usually lodging an agitator 5, which is usually in the form of a rotor axially mounted inside the perforated basket (2) and which impels the load of clothes and washing liquid during a washing step of the laundering process of the laundering machine.

In this construction, the rotation of both the perforated basket 2 and the agitator is achieved by an electric motor and by a control unit (which are not illustrated), said motor transmitting rotation to both the perforated basket and the agitator 5 in a determined direction during the centrifugal operation and, during the washing step, transmitting agitation to the washing liquid and the load of clothes therein, usually in opposite rotation directions relative to each other, and with at least one rotational speed, said rotation directions being changed before a full turn is completed in each said rotation direction and after a stop period.

The control unit determines the rotation rate and rotation angle of the agitator, commanding the on-off motor conditions during predetermined time intervals and inverting the rotation direction each time the motor is turned on.

In the conventional constructions, the laundering process of a laundering machine comprises a soaking step, in which a load of clothes is placed inside the perforated basket 2 and maintained in a resting condition inside the washing liquid, until a washing step of said machine is started, when the load of clothes is submitted to a determined agitation condition, according to the operational characteristics of the laundering machine. These machines usually have, in a final phase of the laundering process, a centrifugal step, in which the already washed clothes are pre-dried in the perforated basket 2. This laundering process has the inconveniences discussed above.

The prior art laundering process of a laundering machine having a perforated basket 2 inside a tank 1 may be summarized by the following sequential steps: filling the tank 1 with washing liquid, up to a determined washing level, which is proportional to the load of clothes to be washed; a static soaking step, with no movement of the load of clothes; agitating the load of clothes and washing liquid by a determined period of time during the washing step; and draining and centrifugal steps. According to the present invention, a laundering machine of the type mentioned above will carry out the laundering process, as described below, in which the water level in the tank 1 does not have any more only one value corresponding to each load of clothes to be washed, but two water levels for each load of clothes; a lower level, during the soaking step; and an upper level, during the washing step.

The control unit commands, automatically, the occurrence of each of said water levels for each choice of water level which may be selected, either by the user, or by an adequate sensing means operatively connected to the control unit. In order to achieve each of the specified levels, the control unit instructs a valve means (not illustrated), which normally blocks the fluid communication between a water source and the inside of the tank 1, to allow the water to pass through a detergent reservoir in the laundering machine, so as to conduct said detergent to the tank 1, until a pressure sensing means indicates that a determined water level has been reached.

The control unit determines the feeding of the washing liquid to the tank 1 to occur, until said liquid reaches a determined soaking level L2, which is selected among a plurality of washing levels. In a laundering machine having, for instance, low, intermediate and high washing levels, the control unit will determine, for each of said levels, a respective soaking level L2, each being for example previously defined as a fraction of the corresponding washing level L1. The determination of the adequate washing level L1 for a certain load of clothes may occur by the user's instruction or by an adequate sensing means, which is operatively connected to the control unit. For any of these conditions, the soaking level L2 may be further defined by the control unit, according to the load of clothes and in order that said load be substantially or completely immersed in the washing liquid during the soaking step.

In the process of the present invention, the soaking step is no more static, presenting an agitation condition, having agitation periods, to be discussed below, intercalated with resting periods Tr, which are longer than the agitation periods, said condition being intermittently repeated, until the soaking step has been completed.

After the washing liquid inside the tank 1 has reached a determined previously established soaking level L2, the load of clothes is initially maintained in a resting condition in the washing liquid during a resting period Tr, until the control unit determines the energization of the agitator 5, go that the latter may start the agitation condition of the soaking step. According to the present invention, the agitation condition comprises a first and a second agitation period, with a time duration Ta1 and Ta2, respectively, the second agitation period Ta2 occurring in a final phase of the soaking step, for example immediately before the washing step, said second agitation period Ta2 having a duration which is inferior to the duration of each resting period Tr and which is superior to the duration of the first agitation period and being, for instance, substantially the same as the resting period Tr.

The agitation condition may be achieved by any proper means which is able to produce, in the load of clothes which is resting in the washing liquid, at least one impelling period Ti, which is sufficient to homogenize the distribution of the detergent through the water mass in the tank 1 and to modify the relative positioning of the pieces of clothes under washing operation. Each impelling period forces the load of clothes and the washing liquid to effect a certain rotation around the shaft of the perforated basket 2 during a determined impelling period Ti.

According to a variant of the present invention, the load of clothes and the washing liquid are alternately submitted to impelling periods, in rotation directions which are opposite to each other and inferior to a full turn around the shaft of the perforated basket 2, during a time interval which is shorter than that necessary for the load of clothes in the washing liquid to reach a resting condition between two consecutive impelling periods. In another variant of the present invention, the load of clothes is alternately submitted to impelling periods, in the same rotation direction, which period may or may not be inferior to a full rotation around the shaft of the perforated basket 2.

For each water level exists a different pattern of agitation rate, which is adjusted in order to achieve an adequate balance of motor effort, movement of the load of clothes and mechanical wear of said clothes being cleaned. Thus, the soaking step of the laundering process of the present invention has an agitation rate, which is different than that associated with the washing step. These different values of agitation rate are achieved by different timings of the on-off conditions of the motor.

According to the present invention, in the agitation condition of the soaking step, the first agitation period Ta1 has a duration corresponding to a small fraction of the resting period Tr and has a first agitation rate, which is for example defined as being a soaking agitation rate, which is lower than a second agitation rate, which is for example defined as a washing agitation rate, each of said soaking agitation and washing agitation rates being maintained unaltered during the duration of the respective step of the laundering process. The second agitation period Ta2 has a duration corresponding to a time interval which is shorter than the resting time and operates by submitting the load of clothes to the first agitation rate.

According to the present invention, after the soaking step has ended, the control unit determines the feeding of washing liquid to the tank 1, until completing a corresponding washing level L1, in order to start the washing step of the laundering machine. This operation occurs as an initial phase of the washing step.

In each agitation period of the agitation condition of the soaking step of the present invention, the first agitation rate, to which the load of clothes in the washing liquid is submitted, is lower than that applied to said washing load during the washing step. As a consequence of using at least one lower water level during the soaking step, a higher detergent concentration in the washing liquid is achieved, which improves the chemical action and consequently the cleaning of the articles to be washed. Moreover, in a laundering machine of the type having a water heating system, in which the heating step coincides with the period in which a lower amount of water is used, time can be saved and electrical consumption can be reduced in order to provide a washing operation with heated water. The combination of the intermittent agitations during the soaking step with the heating function also improves the performance of the laundering machine, since it allows achieving a more homogeneous temperature of the washing liquid, with consequent improvements in the cleaning condition of the load of clothes placed in the perforated basket 2 of the laundering machine, as well as lower energy consumption. The agitation allows achieving a homogenization of the temperature in the tank 1, which is not obtained with the exclusive convection system used in the conventional constructions.

What is claimed is:

1. A laundering process for a laundering machine, which comprises a tank (1), for containing a washing liquid, and a perforated basket (2) for containing the clothes and which is internal to said tank (1), said laundering process comprising a washing step, in which the washing liquid has at least one predetermined washing level (L1) and generally one centrifugal step, said laundering process being characterized in that it includes a soaking step, which precedes the washing step and which comprises the following phases: a)—automatically feeding the tank (1) with the washing liquid, until reaching a determined soaking level (L2), which is lower than a respective washing level (L1); and b)—submitting the load of clothes immersed in the washing liquid, alternately, to a resting condition during a resting period (Tr), and to an agitation condition, during at least one agitation period (Ta1, Ta2), which is shorter than the resting period (Tr), the washing step comprising an initial phase of feeding the tank (1) with washing liquid, until the washing level (L1) has been completed, the agitation condition of the soaking step comprises at least one impelling period (Ti) in which the load of clothes and the washing liquid are forced to effect a certain rotation around the shaft of the perforated basket (2), during an impelling period (Ti).

2. Process, as in claim 1, characterized in that soaking level (L2) is automatically defined according to the load of clothes fed into the perforated basket (2), so that the clothes be substantially immersed in the washing liquid.

3. Process, as in claim 2, characterized in that the washing level (L1) is defined as a complementation of the soaking level (L2), according to a previous determination of the latter.

4. Process, as in claim 1, characterized in that soaking level (L2) is previously defined as a fraction of the respective washing level (L1).

5. Process, as in claim 4, characterized in that impelling period (Ti) occurs in a rotation direction, which is opposite to the rotation direction of the immediately preceding impelling period.

6. Process, as in claim 5, characterized in that, in the agitation condition of the soaking step, the control unit instructs the motor to submit the load of clothes and washing liquid to move according to at least one soaking agitation rate, which is lower than a washing agitation rate.

7. Process, as in claim 1, characterized in that the agitation condition of the soaking step includes a first agitation period (Ta1) corresponding to a small fraction of the resting period (Tr); and a second agitation period (Ta2), which is substantially longer than the first agitation period and shorter than the resting period (Tr).

8. Process, as in claim 7, characterized in that the second agitation period occurs in a final phase of the soaking step immediately before the washing step.

9. A laundering machine, comprising a tank (1) for containing a washing liquid; a perforated basket (2) for containing clothes and placed inside the tank (1), the operation of said laundering machine comprising a washing step, in which the washing liquid has at least one predetermined washing level and, generally, a centrifugal step; a valve means, which selectively allows the tank (1) to be fed with the washing liquid; and an agitator (5), which is selectively driven to cause the load of clothes immersed in the washing liquid to perform agitating movements, said machine being characterized in that it comprises a control unit, which is operatively connected: to the valve means, in order to selectively instruct the feeding of washing liquid to the tank (1), until reaching a determined soaking level (L2), which is lower than a respective washing level (L1); to the agitator (5), in order to actuate it in agitation periods (Ta1, Ta2) of an agitation condition of the soaking step comprising at least one impelling period (Ti) in which the load of clothes and the washing liquid are forced to effect a certain rotation around the shaft of the perforated basket (2), during an impelling period (Ti) and to maintain it inoperative in the resting periods (Tr), during the soaking step, each agitation period (Ta1, Ta2) being shorter than the resting period (Tr).

10. Machine, as in claim 9 and having the perforated basket (2) with a vertical shaft, characterized in that the agitator (5) is in the form of a rotor, which is axially mounted inside the perforated basket (2).

* * * * *